US012188135B2

(12) United States Patent
Fukuchi et al.

(10) Patent No.: US 12,188,135 B2
(45) Date of Patent: Jan. 7, 2025

(54) FLUORINE GAS PRODUCTION DEVICE

(71) Applicant: SHOWA DENKO K.K., Tokyo (JP)

(72) Inventors: Yohsuke Fukuchi, Tokyo (JP); Nozomi Kusumoto, Tokyo (JP); Hiroshi Kobayashi, Tokyo (JP)

(73) Assignee: Resonac Corporation, Tokyo (JP)

( * ) Notice: Subject to any disclaimer, the term of this patent is extended or adjusted under 35 U.S.C. 154(b) by 797 days.

(21) Appl. No.: 17/279,670

(22) PCT Filed: Oct. 7, 2019

(86) PCT No.: PCT/JP2019/039545
§ 371 (c)(1),
(2) Date: Mar. 25, 2021

(87) PCT Pub. No.: WO2020/085066
PCT Pub. Date: Apr. 30, 2020

(65) Prior Publication Data

US 2021/0395901 A1 Dec. 23, 2021

(30) Foreign Application Priority Data

Oct. 24, 2018 (JP) ..... 2018-200220

(51) Int. Cl.
*C25B 1/245* (2021.01)
*C25B 9/19* (2021.01)
(Continued)

(52) U.S. Cl.
CPC ..... *C25B 1/245* (2013.01); *C25B 9/19* (2021.01); *C25B 9/65* (2021.01); *C25B 9/67* (2021.01);
(Continued)

(58) Field of Classification Search
CPC ..... C25B 1/245; C25B 9/65; C25B 9/67
See application file for complete search history.

(56) References Cited

U.S. PATENT DOCUMENTS 3,146,179 A * 8/1964 Davies ..... C25B 1/245 205/411
2003/0047445 A1 3/2003 Tojo et al.
(Continued)

FOREIGN PATENT DOCUMENTS

CA 2 337 650 A1 8/2002
CN 104651873 A 5/2015
(Continued)

OTHER PUBLICATIONS

A.T. Kuhn, "Industrial Electrochemical Processes", edited by Kuhn, Elsevier Publishing Company, 1971, pp. 6-69.
(Continued)

*Primary Examiner* — Ciel P Contreras
(74) *Attorney, Agent, or Firm* — Sughrue Mion, PLLC

(57) ABSTRACT

A fluorine gas production device includes an electrolytic cell, a partition wall extending downward in the vertical direction from the ceiling surface inside the electrolytic cell to partition the electrolytic cell into an anode chamber and a cathode chamber, an anode, and a cathode. The lower end of the partition wall is immersed in the electrolytic solution and a length in the vertical direction of a portion immersed in the electrolytic solution of the partition wall is from 10% to 30% of the distance from the bottom surface inside the electrolytic cell to the liquid level of the electrolytic solution. The cathode is completely immersed in the electrolytic solution and the upper end of the cathode is arranged at a lower position in the vertical direction relative to the lower end of the partition wall. The anode is partially exposed from the liquid level of the electrolytic solution.

16 Claims, 2 Drawing Sheets

(51) Int. Cl.

| | |
|---|---|
| ***C25B 9/65*** | (2021.01) |
| ***C25B 9/67*** | (2021.01) |
| ***C25B 11/02*** | (2021.01) |
| ***C25B 11/046*** | (2021.01) |
| ***C25B 13/00*** | (2006.01) |

(52) U.S. Cl.
CPC ..... *C25B 11/02* (2013.01); *C25B 11/046* (2021.01); *C25B 13/00* (2013.01)

(56) References Cited

U.S. PATENT DOCUMENTS

| | | | | |
|---|---|---|---|---|
| 2004/0099537 | A1* | 5/2004 | Hiraiwa | C25B 1/245 204/243.1 |
| 2004/0149570 | A1 | 8/2004 | Hiraiwa et al. | |
| 2004/0175605 | A1* | 9/2004 | Eshraghi | H01M 8/04014 429/522 |
| 2005/0224366 | A1 | 10/2005 | Hodgson et al. | |
| 2007/0215460 | A1* | 9/2007 | Tojo | C25B 1/245 204/245 |
| 2010/0126875 | A1* | 5/2010 | Maekawa | C25B 1/245 205/619 |
| 2015/0240367 | A1 | 8/2015 | Krouse et al. | |

FOREIGN PATENT DOCUMENTS

| | | | |
|---|---|---|---|
| JP | 40-20246 | B1 | 9/1965 |
| JP | 2766845 | B2 | 6/1998 |
| JP | 2002-339090 | A | 11/2002 |
| JP | 2005-533925 | A | 11/2005 |
| KR | 10-2015-0137321 | A | 12/2015 |

OTHER PUBLICATIONS

International search report for PCT/JP2019/039545 dated Nov. 19, 2019.
International Preliminary Report on Patentability issued Apr. 27, 2021 with translation of the Written Opinion in International Application No. PCT/JP2019/039545.
Extended European Search Report dated Nov. 26, 2021 from the European Patent Office in EP Application No. 19876248.6.

* cited by examiner

FLUORINE GAS PRODUCTION DEVICE

CROSS-REFERENCE TO RELATED APPLICATIONS

This application is a National Stage of International Application No. PCT/JP2019/039545 filed Oct. 7, 2019, which claims priority under U.S.C. § 119 (a) to Japanese Patent Application No. 2018-200220 filed on Oct. 24, 2018.

TECHNICAL FIELD

The present invention relates to a fluorine gas production device.

BACKGROUND ART

Fluorine gas can be synthesized by electrolyzing an electrolytic solution containing hydrogen fluoride (electrolytic synthesis). A fluorine gas production device industrially performing the electrolytic synthesis of fluorine gas includes a partition wall such that fluorine gas generated in an anode and hydrogen gas generated in a cathode are not mixed with each other to prevent a reaction in which the fluorine gas generated in the anode and the hydrogen gas generated in the cathode contact to form hydrogen fluoride (hereinafter sometimes also referred to as a "recombination reaction").

However, in a conventional fluorine gas production device, although the current density of an anode is as low as about 0.1 to 0.15 A/cm$^2$, fluorine gas and hydrogen gas have not been completely separated by a partition wall in some cases. Therefore, a recombination reaction has occurred in an electrolytic solution, the hydrogen gas has leaked into an anode chamber to cause the recombination reaction with the fluorine gas in a gas phase part, or the fluorine gas has leaked into a cathode chamber to cause the recombination reaction with the hydrogen gas in the gas phase part in some cases, which has caused a reduction in current efficiency. Further, when the electrolysis is performed at a high current density, the separability between the fluorine gas and the hydrogen gas decreases, and therefore the current efficiency reduction degree has tended to increase.

PTL 1 discloses a technology of increasing the separability between a gas generated in an anode and a gas generated in a cathode by controlling the length in the vertical direction of a portion immersed in an electrolytic solution of a partition wall. However, the separability between both the gases has not been sufficient, so that a reduction in current efficiency has not been able to be sufficiently prevented.

NPL 1 discloses the design of an industrially used electrolytic cell for producing fluorine gas but the electrolytic cell is an electrolytic cell performing electrolysis at a current density of less than 0.2 A/cm$^2$ and is not an electrolytic cell capable of performing electrolysis at a high current density.

CITATION LIST

Patent Literature

PTL 1: Japanese Patent No. 2766845

Non Patent Literature

NPL 1: "Industrial Electrochemical Processes", edited by Kuhn, Elsevier Publishing Company, 1971, p.p. 6-69

SUMMARY OF INVENTION

Technical Problem

It is an object of the present invention to provide a fluorine gas production device in which, even when an electrolytic solution containing hydrogen fluoride is electrolyzed at a high current density, a recombination reaction in the electrolytic solution and a recombination reaction in gas phase parts of an anode chamber and a cathode chamber are less likely to occur and the electrolytic solution can be electrolyzed with high current efficiency to produce fluorine gas.

Solution to Problem

In order to solve the above-described problems, one aspect of the present invention is as described in [1] to [8] below.

[1] A fluorine gas production device electrolyzing an electrolytic solution containing hydrogen fluoride to electrolytically synthesize fluorine gas includes an electrolytic cell configured to store the electrolytic solution, a cylindrical partition wall configured to extend downward in the vertical direction from the ceiling surface inside the electrolytic cell to partition the inside of the electrolytic cell into an anode chamber and a cathode chamber, an anode configured to be disposed in the anode chamber, and a cathode configured to be disposed facing the anode, in which the lower end of the partition wall is immersed in the electrolytic solution, the length in the vertical direction of the portion immersed in the electrolytic solution of the partition wall is 10% or more and 30% or less of the distance from the bottom surface inside the electrolytic cell to the liquid level of the electrolytic solution, the cathode is completely immersed in the electrolytic solution, the upper end of the cathode is arranged at the same position in the vertical direction as the position of the lower end of the partition wall or at a lower position in the vertical direction relative to the lower end of the partition wall, and the anode is placed to be partially exposed from the liquid level of the electrolytic solution.

[2] The fluorine gas production device according to [1] further includes an anode connection member configured to supply power to the anode and a cathode connection member configured to supply power to the cathode, in which the anode connection member has one end connected to a positive electrode of a direct-current power supply and the other end penetrating a wall body of the electrolytic cell to be connected to the anode, the anode connection member and the electrolytic cell are insulated from each other, the cathode connection member has one end connected to a bottom wall or a portion at a lower position in the vertical direction relative to the lower end of the partition wall of a side wall of the electrolytic cell and the other end connected to the cathode, and the electrolytic cell and a negative electrode of the direct-current power supply are connected to each other.

[3] The fluorine gas production device according to [2], in which the cathode connection member is a metal pipe allowing the circulation of a fluid.

[4] The fluorine gas production device according to any one of [1] to [3], in which the anode and the cathode have a flat plate shape, the anode, the cathode, the partition wall, and the side surface inside the electrolytic cell are provided to be parallel in the vertical direction, a shortest distance A between the anode and the cathode is 2.0 cm or more and 5.0 cm or less, a shortest distance B between the anode and the partition wall is 0.5 cm or more and 2.5 cm or less and is smaller than the shortest distance A, and a shortest distance C between a portion not facing the cathode of the anode and the side surface inside the electrolytic cell is 1.5 times or more and 3 times or less the shortest distance A.

[5] The fluorine gas production device according to any one of [1] to [4], in which the bottom surface inside the electrolytic cell is covered with an electrically insulating layered member formed of fluororesin or ceramic.

[6] The fluorine gas production device according to any one of [1] to [5], in which a portion facing the anode of the cathode is formed of at least one type of material selected from Monel (Trademark), nickel, and copper.

[7] The fluorine gas production device according to any one of [1] to [6], in which the portion facing the anode of the cathode is constituted by a flat plate or a flat plate including a through-hole with an opening ratio of 20% or less.

[8] The fluorine gas production device according to any one of [1] to [7] does not include a diaphragm configured to extend downward in the vertical direction from the partition wall to partition the inside of the electrolytic cell into the anode chamber and the cathode chamber.

Advantageous Effects of Invention

According to the present invention, even when an electrolytic solution containing hydrogen fluoride is electrolyzed at a high current density, a recombination reaction in the electrolytic solution and a recombination reaction in gas phase parts of an anode chamber and a cathode chamber are less likely to occur and the electrolytic solution can be electrolyzed with high current efficiency to produce fluorine gas.

DESCRIPTION OF EMBODIMENTS

An embodiment of the present invention will now be described below. This embodiment describes an example of the present invention and the present invention is not limited to this embodiment. Further, this embodiment can be variously altered or modified and embodiments obtained by such alternations or modifications may also be included in the present invention.

Figure 1:
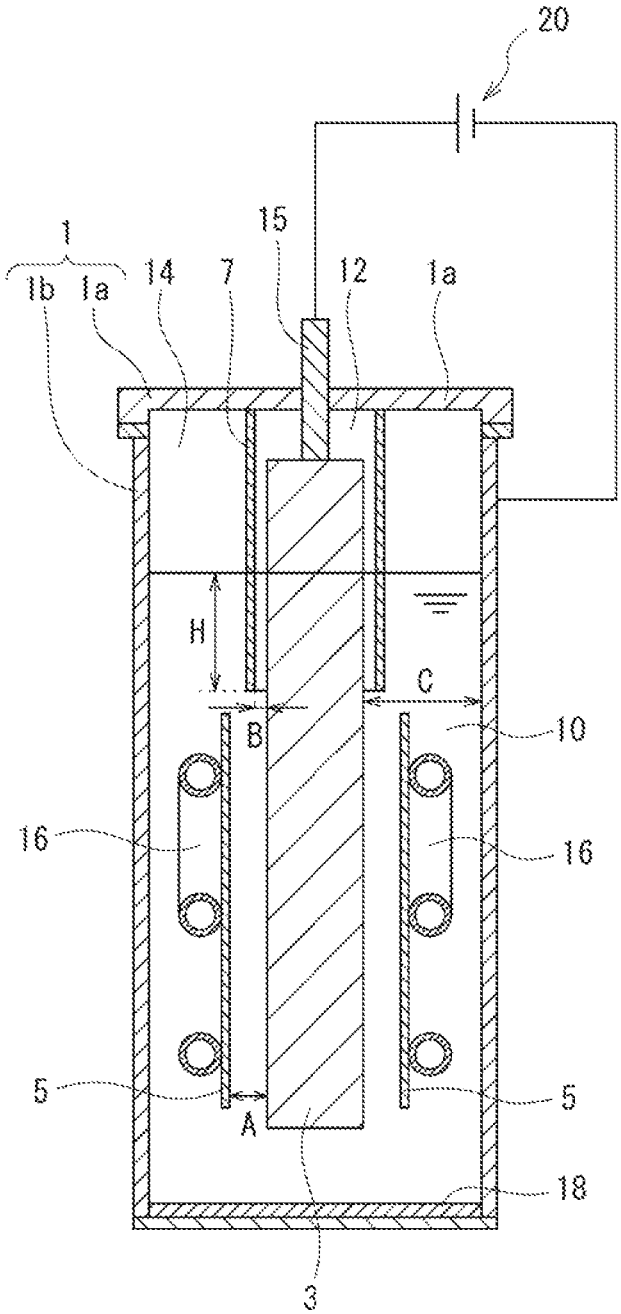
FIG. 1 is a cross-sectional view for explaining the structure of a fluorine gas production device according to one embodiment of the present invention.
Figure 2:
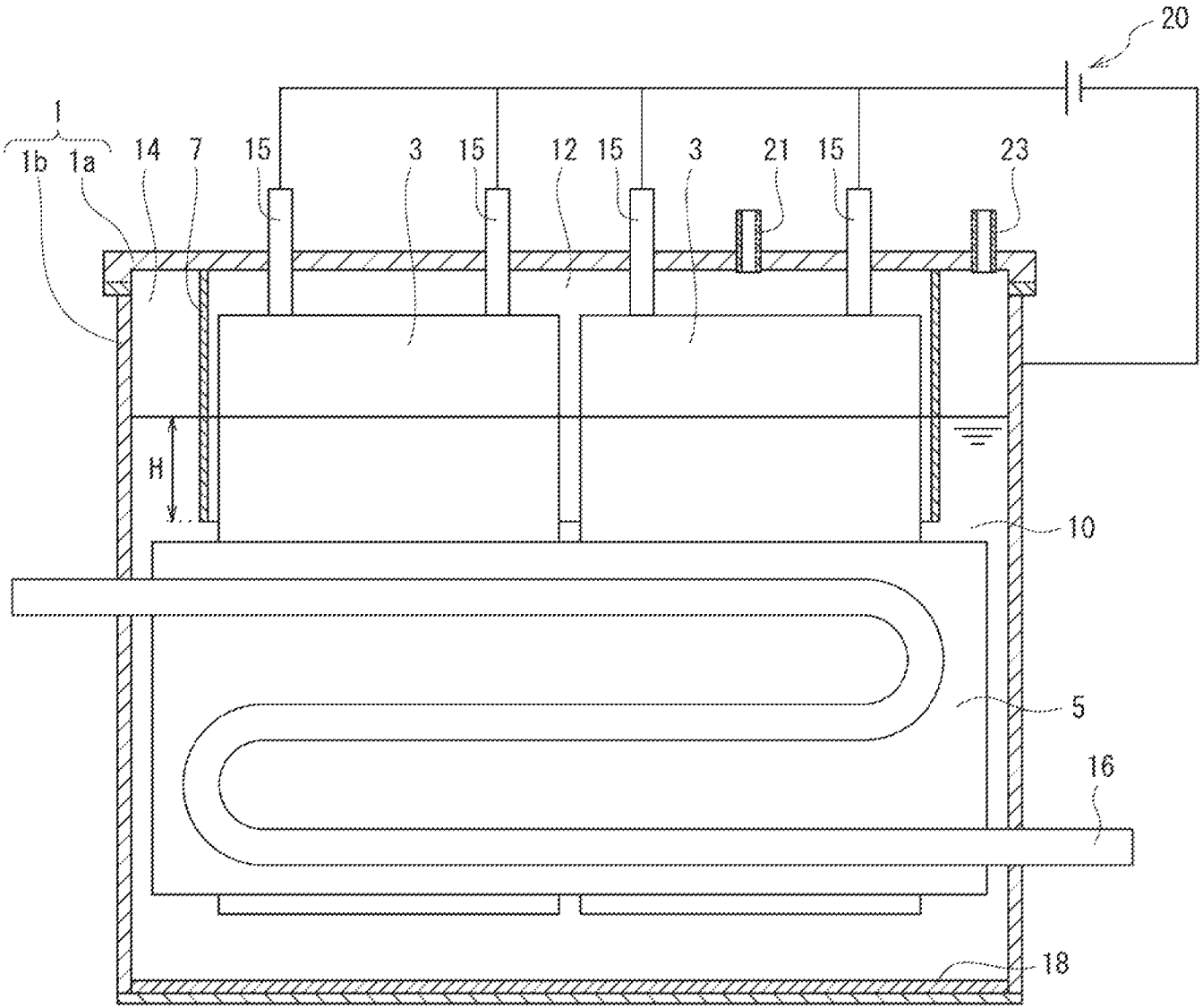
FIG. 2 is a cross-sectional view illustrating the fluorine gas production device of FIG. 1 virtually cut along a plane different from a plane of FIG. 1.

The structure of a fluorine gas production device according to this embodiment is described referring to FIG. 1 and FIG. 2. FIG. 1 is a cross-sectional view illustrating the fluorine gas production device virtually cut along a plane orthogonal to and parallel in the vertical direction to the plate surfaces of an anode 3 and a cathode 5 of the fluorine gas production device. FIG. 2 is a cross-sectional view illustrating the fluorine gas production device virtually cut along a plane parallel to and parallel in the vertical direction to the plate surfaces of the anode 3 and the cathode 5 of the fluorine gas production device.

The fluorine gas production device illustrated in FIG. 1 and FIG. 2 is a device electrolyzing an electrolytic solution 10 containing hydrogen fluoride to electrolytically synthesize fluorine gas. The fluorine gas production device includes an electrolytic cell 1 storing the electrolytic solution 10 thereinside, the anode 3 disposed inside the electrolytic cell 1 to be immersed in the electrolytic solution 10, and the cathode 5 disposed inside the electrolytic cell 1 to be immersed in the electrolytic solution 10 and disposed facing the anode 3.

The inside of the electrolytic cell 1 is partitioned into an anode chamber 12 and a cathode chamber 14 by a cylindrical partition wall 7 extending downward in the vertical direction from the ceiling surface inside the electrolytic cell 1 (rear surface of a lid 1*a* of the electrolytic cell 1 in the example of FIG. 1 and FIG. 2). When described in detail, the anode chamber 12 contains an internal region surrounded by the cylindrical partition wall 7 and a region under the region. The cathode chamber 14 contains a region outside the cylindrical partition wall 7 and a region under the region. The anode 3 is disposed in the anode chamber 12. The cathode 5 is disposed in the cathode chamber 14. However, space above the liquid level of the electrolytic solution 10 is separated into space in the anode chamber 12 and space in the cathode chamber 14 by the partition wall 7. While an upper portion relative to the lower end of the partition wall 7 of the electrolytic solution 10 is separated by the partition wall 7, a lower portion relative to the lower end of the partition wall 7 of the electrolytic solution 10 is not directly separated by the partition wall 7 and continuous.

The anode 3 is not particularly limited in shape and may have a columnar shape, for example. In this embodiment, the anode 3 has a flat plate shape and is disposed in the anode chamber 12 such that the plate surfaces thereof are parallel to each other in the vertical direction. The cathode 5 is not particularly limited in shape and may have a columnar shape, for example. In this embodiment, the cathode 5 has a flat plate shape and is disposed in the cathode chamber 14 such that the plate surfaces thereof face the plate surfaces of the anode 3 in parallel thereto and the two cathodes 5, 5 interpose the anode 3 therebetween.

The shape of the partition wall 7 is not particularly limited insofar as the partition wall 7 has a cylindrical shape and may be a circular cylindrical shape or a rectangular cylindrical shape. In this embodiment, the partition wall 7 has a square cylindrical shape. The partition wall 7 is disposed such that four wall bodies are parallel to each other in the vertical direction and two each of wall bodies facing each other among the four wall bodies face both the plate surfaces of the anode 3 in parallel thereto.

The shape of the electrolytic cell 1 is not particularly limited and has a rectangular parallelepiped shape in this embodiment. Four side walls of the electrolytic cell 1 are provided to be parallel to each other in the vertical direction and face the four wall bodies of the partition wall 7 in parallel thereto. Hence, the side surfaces inside the electrolytic cell 1 (i.e., inside surfaces of the side walls of the electrolytic cell 1) are parallel to each other in the vertical direction and face the plate surfaces of the anode 3, the plate surfaces of the cathode 5, and the two each of wall bodies facing both the plate surfaces of the anode 3 among the four wall bodies of the partition wall 7 in parallel thereto.

In the fluorine gas production device of this embodiment of such a structure, the cathode 5 is placed to be completely immersed in the electrolytic solution 10 and the anode 3 is placed to be partially exposed from the liquid level of the electrolytic solution 10. The lower end of the partition wall 7 is immersed in the electrolytic solution 10 and a length H in the vertical direction of the portion immersed in the electrolytic solution 10 of the partition wall 7 (hereinafter also sometimes referred to as a "partition wall immersion length H") is set to 10% or more and 30% or less of the distance from the bottom surface inside the electrolytic cell 1 to the liquid level of the electrolytic solution 10 (hereinafter also sometimes referred to as a "liquid level height"). The upper end of the cathode 5 is arranged at the same position in the vertical direction as that of the lower end of the partition wall 7 or at a lower position in the vertical direction relative to the lower end of the partition wall 7 (in the example of FIG. 1 and FIG. 2, the upper end of the cathode 5 is arranged at a lower position in the vertical direction relative to the lower end of the partition wall 7).

When a current with a current density of 0.2 $A/cm^2$ or more and 1 $A/cm^2$ or less, for example, is supplied between the anode 3 and the cathode 5 of the fluorine gas production device of this embodiment, the electrolytic solution 10 is electrolyzed, so that anode gas containing fluorine gas ($F_2$) as a main component is generated in the anode 3 and cathode gas containing hydrogen gas ($H_2$) as a main component is generated as a byproduct in the cathode 5.

The anode gas is accumulated in space above the liquid level of the electrolytic solution 10 in the anode chamber 12. The cathode gas is accumulated in space above the liquid level of the electrolytic solution 10 in the cathode chamber 14. The space above the liquid level of the electrolytic solution 10 is partitioned by the partition wall 7 into space in the anode chamber 12 and space in the cathode chamber 14, and therefore the anode gas and the cathode gas are not mixed with each other.

The anode chamber 12 includes an exhaust port 21 discharging the anode gas generated in the anode 3 from the inside of the anode chamber 12 to the outside of the electrolytic cell 1. The cathode chamber 14 includes an exhaust port 23 discharging the cathode gas generated in the cathode 5 from the inside of the cathode chamber 14 to the outside of the electrolytic cell 1.

On the plate surfaces opposite to the plate surfaces facing the anode 3 among both the front and rear plate surfaces of the cathode 5, cooling units for cooling the cathode 5 and the electrolytic solution 10 are mounted. In the example of the electrolytic device illustrated in FIG. 1 and FIG. 2, a cooling pipe 16 which is a metal pipe and through which a cooling fluid, such as water, flows is mounted as the cooling unit on the cathode 5. The cathode 5 and the electrolytic solution 10 can also be warmed by letting a warming fluid, such as steam, flow through the cooling pipe 16.

When electrolyzed, Joule heat is generated. Therefore, it is required to cool the electrolytic solution 10. However, when the cathode 5 is cooled, the specific gravity increases due to a reduction in temperature of the electrolytic solution 10. Therefore, a downward flow described below is promoted on the rear surface (surface opposite to the surface on the side facing the anode 3) of the cathode 5. As a result, the leakage into the anode chamber 12 of hydrogen gas is less likely to occur, so that a reduction in current efficiency is suppressed. When the electrolysis is stopped, the electrolytic solution 10 is required to be warmed. Therefore, it is preferable to enable the circulation of the warming fluid, such as steam, in the cooling pipe 16. The electric conductivity of the circulating water or steam is desirably lower. When water with high electric conductivity is used, there is a risk that a leakage current flows into water, so that the current efficiency decreases.

By using the fluorine gas production device of this embodiment of such a structure, even when the electrolytic solution 10 containing hydrogen fluoride is electrolyzed at a high current density (for example, 0.2 $A/cm^2$ or more and 1 $A/cm^2$ or less), a recombination reaction in the electrolytic solution 10 and a recombination reaction in gas phase parts of the anode chamber 12 and the cathode chamber 14 are less likely to occur and the electrolytic solution 10 can be electrolyzed with high current efficiency to industrially produce fluorine gas. Effects obtained by the structure of the fluorine gas production device of this embodiment are described in detail below.

(1) Configuration in which the cathode is completely immersed in the electrolytic solution and the upper end of the cathode is arranged at the same position in the vertical direction as that of the lower end of the partition wall or at a lower position in the vertical direction relative to the lower end of the partition wall Since the upper end of the cathode 5 is arranged at the same position in the vertical direction as that of the lower end of the partition wall 7 or at a lower position in the vertical direction relative to the lower end of the partition wall 7, an effect that double-polarization of the partition wall 7 is suppressed is exhibited. When the partition wall is interposed between the anode and the cathode, an interposed portion of the partition wall causes double-polarization. Therefore, hydrogen gas is generated in a portion facing the anode of the partition wall or fluorine gas is generated in a portion facing the cathode of the partition wall. As a result, the current efficiency sometimes decreases and the portion facing the cathode of the partition wall is reduced in thickness to deteriorate due to galvanic corrosion. In the fluorine gas production device of this embodiment, the partition wall 7 is not interposed between the anode 3 and the cathode 5, and therefore the double-polarization of the partition wall 7 is suppressed and a reduction in current efficiency or a deterioration of the partition wall 7 is less likely to occur.

Further, the cathode 5 is placed to be completely immersed in the electrolytic solution 10 and the upper end of the cathode 5 is arranged at the lower position in the vertical direction relative to the liquid level of the electrolytic solution 10, and therefore an effect that the current efficiency in the electrolysis is improved is exhibited. This point is described in detail below.

Bubbles of the hydrogen gas generated in the cathode 5 are very fine bubbles. The bubbles rise to reach the liquid level of the electrolytic solution 10. However, even when the bubbles reach the liquid level of the electrolytic solution 10, all the bubbles are not instantly burst into the gas phase part and some of the bubbles move with the flow of the bath flow of the electrolytic solution 10 to stay in the electrolytic solution 10.

When the upper end of the cathode is located above the liquid level of the electrolytic solution, an upward flow of the electrolytic solution is generated with the generation of the bubbles in the portion facing the anode of the cathode but a place where the downward flow of the electrolytic solution is generated is only a place in the vicinity of the partition wall. Therefore, the upward flow and the downward flow are generated in a portion where the cathode and the partition wall face each other. Hence, the bubbles of the hydrogen gas produce a vortex between the cathode and the partition wall and stay. The staying portion of the bubbles of the hydrogen gas gradually grows after starting a current application, so that the vortex containing the bubbles of the hydrogen gas is generated up to the vicinity of the lower end of the partition wall. Then, the bubbles of the hydrogen gas get over the partition wall to flow into the anode chamber, so that the current efficiency decreases.

On the other hand, when the upper end of the cathode 5 is located under the liquid level of the electrolytic solution 10, the upward flow of the electrolytic solution 10 is generated with the generation of the bubbles in the portion facing the anode 3 of the cathode 5. However, the electrolytic solution 10 can flow between the upper end of the cathode 5 and the liquid level of the electrolytic solution 10, and therefore a bath flow toward the rear surface side of the cathode 5 is generated, so that a downward flow of the electrolytic solution 10 is generated on the rear surface side of the cathode 5. Therefore, the leakage amount of the bubbles of the hydrogen gas staying in the electrolytic solution 10 into the anode chamber 12 decreases, and thus a reduction in current efficiency is less likely to occur.

As described above, by using the fluorine gas production device of this embodiment, the fluorine gas and the hydrogen gas can be separated with high separability by suppressing the leakage into the anode chamber 12 of the hydrogen gas generated in the cathode 5. Therefore, even when the electrolysis is performed at a high current density, the electrolytic solution 10 containing hydrogen fluoride can be electrolyzed with high current efficiency to produce fluorine gas.

(2) Configuration in which the lower end of the partition wall is immersed in the electrolytic solution and the immersion length H of the partition wall is 10% or more and 30% or less of the liquid level height When the immersion length H of the partition wall 7 is 10% or more of the liquid level height, the leakage amount of the bubbles of the hydrogen gas into the anode chamber 12 decreases, and therefore a reduction in current efficiency is less likely to occur. On the other hand, when the immersion length H of the partition wall 7 is 30% or less of the liquid level height, portions functioning as electrodes of the anode 3 and the cathode 5 increase in number, and therefore the amount of the electrolytic solution 10 to be electrolyzed also increases, which is economical. More specifically, the portions facing the partition wall 7 of the anode 3 and the cathode 5 are less likely to function as electrodes, and therefore the immersion length H of the partition wall 7 is preferably smaller. The immersion length H of the partition wall 7 is required to be 10% or more and 30% or less of the liquid level height but is more preferably 12% or more and 20% or less of the liquid level height.

When the hydrogen fluoride in the electrolytic solution is consumed by the electrolysis reaction, so that the liquid level height is lowered, it is preferable to maintain the ranges above by replenishing hydrogen fluoride. As a method for maintaining the ranges above, the following methods can be mentioned, for example.

First, a method is mentioned which includes determining the liquid level height of the electrolytic solution using a nitrogen gas blowing-type differential pressure gauge immersed in the electrolytic solution in the cathode chamber 14, detecting a reduction in the liquid level height, and then, when a preset liquid level height reduction amount is reached, replenishing hydrogen fluoride. The water column pressure corresponding to the immersion length H of the partition wall 7 is determined by the differential pressure gauge, and then the immersion length H of the partition wall 7 can be determined from the pressure.

Secondary, a method using two liquid level sensors of a type of measuring the electrical resistance is mentioned. More specifically, an upper sensor (A sensor) and a lower sensor (B sensor) are placed, and then, when it is detected that both the sensors are separated from liquid, the supply of hydrogen fluoride can be started and, when both the sensors are immersed in liquid, the supply of hydrogen fluoride is stopped, whereby the level height can be controlled.

(3) Configuration in which the anode is partially exposed from the liquid level of the electrolytic solution The anode connection member 15 supplying power to the anode 3 is sometimes connected to the anode 3. For joining the anode 3 and the anode connection member 15, a means, such as bolt joint or welding joint, is used. However, when a joint portion between the anode 3 and the anode connection member 15 is immersed in the electrolytic solution 10, there is a risk of corrosion or an increase in electrical resistance. When the anode 3 is partially exposed from the liquid level of the electrolytic solution 10, the exposed portion and the anode connection member 15 can be joined to each other, so that the immersion in the electrolytic solution 10 can be prevented. Bubbles of the fluorine gas generated in the anode 3 are larger than the bubbles of the hydrogen gas. Therefore, even when the upper end of the anode 3 is located above the liquid level of the electrolytic solution 10, the downward flow of the electrolytic solution 10 is less likely to generate between the anode 3 and the partition wall 7.

The fluorine gas produced by the fluorine gas production device of this embodiment is usable as starting materials in chemically synthesizing fluorine containing compounds, such as uranium hexafluoride ($UF_6$), sulfur hexafluoride ($SF_6$), carbon tetrafluoride ($CF_4$), and nitrogen trifluoride. The fluorine gas or the fluorine containing compounds, such as uranium hexafluoride, sulfur hexafluoride, carbon tetrafluoride, and nitrogen trifluoride, are useful in the nuclear industry field, the semiconductor industry field, the pharmaceutical and agrochemical field, the consumer product field, and the like.

Hereinafter, the fluorine gas production device according to this embodiment is described in more detail.

(a) Electrolytic Cell

Although a material of the electrolytic cell 1 performing electrolytic synthesis is not particularly limited, it is preferable to use copper, soft steel, Monel (Trademark), nickel alloy, fluororesin, and the like from the viewpoint of corrosion resistance.

When power is supplied to the anode 3 or the cathode 5 via the electrolytic cell 1, the electrolytic cell 1 is required to be formed of conductive materials, such as metal. However, when power is supplied to the anode 3 or the cathode 5 not via the electrolytic cell 1, the electrolytic cell 1 is not required to be formed of conductive materials and may be formed of insulating materials.

The electrolytic cell 1 may be an integrated type which is not divided into a plurality of members or may be a separate type containing a plurality of separable members. The electrolytic cell 1 of the fluorine gas production device illustrated in FIG. 1 and FIG. 2 is the separate type and contains a body 1*b* storing the electrolytic solution 10 and the lid 1*a* closing an upper opening of the body 1*b*. The lid 1*a* and the body 1*b* are preferably attached to have airtightness to prevent fluorine gas and hydrogen gas from leaking out to the outside of the electrolytic cell 1.

Although details are described later, the fluorine gas production device illustrated in FIG. 1 and FIG. 2 is configured so that power is supplied to the cathode 5 via the body 1*b* of the electrolytic cell 1, and therefore the body 1*b* is formed of conductive materials, such as metal. In this case, when the lid 1*a* is also formed of conductive materials, such as metal, the lid 1*a* and the body 1*b* is required to be insulated from each other.

(b) Anode

A material of the anode 3 is not particularly limited insofar as the material is usable in an electrolytic solution containing hydrogen fluoride. For example, metal and carbon are usable and carbon electrodes covered with conductive diamond can be preferably used, for example.

The shape of the anode 3 is not particularly limited and can be freely designed, e.g., a flat plate shape, a mesh shape, a punching plate shape, a rounded plate-like shape, a shape by which generated bubbles are guided to the rear surface of an electrode, a three-dimensional structure considering the circulation of an electrolytic solution, and the like. The punching plate is a flat plate subjected to punching work of forming a through-hole.

(c) Cathode

A material of the cathode 5 is not particularly limited insofar as the material is usable in an electrolytic solution containing hydrogen fluoride. For example, metal is usable. Examples of the type of the metal include iron, copper, nickel, and Monel (Trademark), for example. In particular, the portion facing the anode 3 of the cathode 5 is preferably formed of at least one type of material selected from Monel (Trademark), nickel, and copper and is more preferably formed of Monel (Trademark).

The diameter of the bubbles of hydrogen gas to be generated tends to vary depending on the metal type. When the diameter of the bubbles of the hydrogen gas is larger, the separability by the partition wall 7 between the fluorine gas and the hydrogen gas is excellent. When iron is used as the material of the cathode 5, the diameter of the bubbles of hydrogen gas to be generated is relatively small. However, when Monel (Trademark) is used as the material of the cathode 5, the diameter of the bubbles of hydrogen gas to be generated is relatively large. Therefore, the bubbles of the generated hydrogen gas rise upward in the vertical direction from the cathode 5 and the bubbles involved in the vortex decrease in number. Therefore, the separability by the partition wall 7 between the fluorine gas and the hydrogen gas is improved and the current efficiency increases. Nickel or copper is inferior to Monel (Trademark) in strength but the diameter of the bubbles of hydrogen gas to be generated is almost the same as that of Monel (Trademark).

The shape of the anode 3 is the same as the shape of the cathode 5. The portion facing the anode 3 of the cathode 5 is preferably constituted by a flat plate or constituted by a flat plate including through-holes with an opening ratio of 20% or less (i.e., punching plate). In particular, constituting the portion facing the anode 3 of the cathode 5 by a flat plate is preferable because the bubbles of the hydrogen gas rise at a component of velocity containing only a vertical component when rising. When the rising speed of the bubbles in the electrolytic solution 10 is higher, the bubbles are more easily burst on the liquid level. Therefore, it is important for ease of bursting of the bubbles that the component of velocity in the rise of the bubbles is only the vertical component.

Opening portions of the through-holes of the punching plate are not particularly limited in shape and size but preferably have an opening ratio of 20% or less. Even a punching plate having an opening ratio larger than 20% is usable. However, due to the presence of the opening portions of the through-holes, there is a risk that the rise of the bubbles of the hydrogen gas is blocked and a component of velocity in the horizontal direction is generated, which reduces the separability by the partition wall between the fluorine gas and the hydrogen gas. The opening ratio is calculated as a percentage of a value obtained by dividing "Total opening area of the opening portions of all the through-holes" by "Area obtained by the product of the vertical length and the horizontal length of the portion facing the anode of the cathode".

(d) Electrolytic Solution

An example of an electrolytic solution is described. As the electrolytic solution, a molten salt containing hydrogen fluoride (HF) is usable. For example, a mixed molten salt of hydrogen fluoride and potassium fluoride (KF), a mixed molten salt of hydrogen fluoride and cesium fluoride (CsF), and a mixed molten salt of hydrogen fluoride, potassium fluoride, and cesium fluoride are usable.

In the mixed molten salt of hydrogen fluoride and potassium fluoride, the molar ratio of the hydrogen fluoride and the potassium fluoride can be set to Hydrogen fluoride: Potassium fluoride=1.5 to 2.5:1, for example. In the mixed molten salt of hydrogen fluoride and cesium fluoride, the molar ratio of the hydrogen fluoride and the cesium fluoride can be set to Hydrogen fluoride:Cesium fluoride=1.0 to 4.0:1, for example. In the mixed molten salt of hydrogen fluoride, potassium fluoride, and cesium fluoride, the molar ratio of the hydrogen fluoride, the potassium fluoride, the cesium fluoride can be set to Hydrogen fluoride:Potassium fluoride:Cesium fluoride=1.5 to 4.0:0.01 to 1.0:1, for example.

When the electrolytic solution 10 is the mixed molten salt of hydrogen fluoride and potassium fluoride, the hydrogen fluoride concentration of the electrolytic solution 10 during electrolysis is preferably 38% by mass or more and 42% by mass or less. The hydrogen fluoride concentration of the electrolytic solution 10 during electrolysis can be controlled as follows. More specifically, when the relationship among the replenishment amount of hydrogen fluoride to the electrolytic solution 10, the liquid level height of the electrolytic solution 10, and the hydrogen fluoride concentration of the electrolytic solution 10 is grasped in advance, and then hydrogen fluoride is replenished to the electrolytic solution 10 to control the liquid level height of the electrolytic solution 10, whereby the hydrogen fluoride concentration of the electrolytic solution 10 can be controlled within the ranges above.

The electrolytic solution generally contains moisture in a proportion of 0.1% by mass or more and 5% by mass or less. When the moisture contained in the electrolytic solution is larger than 3% by mass, the electrolytic solution may be used for electrolysis after the moisture contained in the electrolytic solution is reduced to be 3% by mass or less by a method described in JP 7-2515 A, for example. In general, it is difficult to simply reduce the moisture amount in the electrolytic solution. Therefore, when fluorine gas is electrolytically synthesized in an industrial manner, it is preferable to use hydrogen fluoride having a moisture content of 3 mass % or less as a raw material from the viewpoint of cost.

(e) Current Density

The current density of a current supplied to the anode 3 in electrolysis is not particularly limited and can be set to 0.2 $A/cm^2$ or more and 1 $A/cm^2$ or less. By using the fluorine gas production device of this embodiment, even when the electrolytic solution 10 is electrolyzed at a current density as high as 0.2 $A/cm^2$ or more and 1 $A/cm^2$ or less, a recombination reaction in the electrolytic solution 10 and a recombination reaction in the gas phase parts of the anode chamber 12 and the cathode chamber 14 are less likely to occur and the electrolytic solution 10 can be electrolyzed with high current efficiency to produce fluorine gas.

When the anode is not a porous body or not subjected to surface roughening treatment, the above-described current density may be a current per surface area of the anode when it is supposed that the surface is smooth, i.e., apparent current density.

(f) Arrangement of Anode, Cathode, and Partition Wall

It is preferable to arrange the anode 3, the cathode 5, and the partition wall 7 to satisfy the following three conditions (see FIG. 1).

The shortest distance A between the anode 3 and the cathode 5 is 2.0 cm or more and 5.0 cm or less.

The shortest distance B between the anode 3 and the partition wall 7 is 0.5 cm or more and 2.5 cm or less and is smaller than the shortest distance A.

The shortest distance C between the portion not facing the cathode 5 of the anode 3 and the side surfaces inside the electrolytic cell 1 is 1.5 times or more and 3 times or less the shortest distance A.

When the shortest distance A between the anode 3 and the cathode 5 is 2.0 cm or more, the separability by the partition wall 7 between the fluorine gas and the hydrogen gas is excellent and the current efficiency easily increases. When the shortest distance A between the anode 3 and the cathode 5 is 5.0 cm or less, the resistance of the electrolytic solution 10 decreases and the electrolytic voltage decreases, and therefore a loss of power consumption is less likely to occur, which is economical.

When the shortest distance B between the anode 3 and the partition wall 7 is 0.5 cm or more, the separability by the partition wall 7 between the fluorine gas and the hydrogen gas is excellent and the current efficiency easily increases. When the shortest distance B between the anode 3 and the partition wall 7 is 2.5 cm or less, a downward flow is less likely to be formed between the anode 3 and the partition wall 7. Therefore, a deterioration of the current efficiency due to the involvement of the hydrogen gas generated in the cathode 5 in the downward flow is less likely to occur. Further, when the shortest distance B between the anode 3 and the partition wall 7 is 2.5 cm or less, the resistance of the electrolytic solution 10 decreases and the electrolytic voltage decreases, and therefore a loss of power consumption is less likely to occur, which is economical.

When the shortest distance C between the portion not facing the cathode 5 of the anode 3 and the side surfaces inside the electrolytic cell 1 is 1.5 times or more the shortest distance A, the partition wall 7 interposed between the anode 3 and the side surfaces (side walls) inside the electrolytic cell 1 is less likely to cause double-polarization, and therefore the current efficiency is less likely to decrease. When the shortest distance C between the portion not facing the cathode 5 of the anode 3 and the side surfaces inside the electrolytic cell 1 is 3 times or less the shortest distance A, the electrolytic cell 1 is reduced in size and the use amount of the electrolytic solution 10 decreases, which are economical.

(g) Connection Member

To the anode 3 or the cathode 5, power may be directly supplied or power may be supplied via a connection member. In the example of FIG. 1 and FIG. 2, the fluorine gas production device further includes the anode connection member 15 and the cathode connection member 16, so that power is supplied to the anode 3 via the anode connection member 15 and power is supplied to the cathode 5 via the cathode connection member 16.

The anode connection member 15 is a rod-like member, for example, one end of which is connected to a positive electrode of the direct-current power supply 20 and the other end of which penetrates the lid 1*a* of the electrolytic cell 1 to be connected to the anode 3. When the lid 1*a* of the electrolytic cell 1 is formed of conductive materials, such as metal, the anode connection member 15 and the lid 1*a* of the electrolytic cell 1 are insulated from each other.

In the fluorine gas production device of this embodiment, the cooling pipe 16 is used also as the cathode connection member. More specifically, the cathode connection member 16 is a metal pipe, for example, one ends of which are connected, by a method, such as welding, to portions at a lower position in the vertical direction relative to the lower end of the partition wall 7 of the side walls of the body 1*b* of the electrolytic cell 1 (may be connected to the bottom wall of the body 1*b* of the electrolytic cell 1) and the other ends of which are connected to the cathode 5. The wall bodies of the body 1*b* of the electrolytic cell 1 are formed of conductive materials, such as metal, and the side walls of the body 1*b* of the electrolytic cell 1 and further a negative electrode of the direct-current power supply 20 are connected to each other, and therefore a current is supplied to the cathode 5 via the side walls of the body 1*b* of the electrolytic cell 1 and the cathode connection member 16.

When the cathode connection member 16 is connected to the portions at the lower position in the vertical direction relative to the lower end of the partition wall 7 of the side walls of the body 1*b* of the electrolytic cell 1 or connected to the bottom wall of the electrolytic cell 1, the partition wall 7 is not structured to be interposed between the anode 3 and the cathode connection member 16, and therefore the partition wall 7 is less likely to cause double-polarization and is likely to achieve excellent current efficiency.

Further, a negative voltage is applied to the body 1*b* of the electrolytic cell 1. Therefore, when the lid 1*a* of the electrolytic cell 1 is also formed of conductive materials, such as metal, it is preferable to insulate the lid 1*a* and the body 1*b* of the electrolytic cell 1 from each other such that the partition wall 7 connected to the lid 1*a* of the electrolytic cell 1 has an electrically neutral voltage. When the partition wall 7 has the electrically neutral voltage, the partition wall 7 is less likely to be an anode or a cathode, and therefore excellent current efficiency is achieved.

(h) Others (h-1) Sheet

The bottom surface inside the electrolytic cell 1 may be covered with the electrically insulating layered member 18 formed of fluororesin or ceramic. As the layered member 18, a sheet-like member or a film-like member is mentioned. When the electrically insulating layered member 18 covers the bottom surface inside the electrolytic cell 1, a current does not flow between the bottom surface inside the electrolytic cell 1 and the anode 3 even when the wall bodies of the electrolytic cell 1 are formed of conductive materials. Hence, the generation of hydrogen gas on the bottom surface inside the electrolytic cell 1 can be suppressed. Therefore, a recombination reaction of hydrogen gas generated on the bottom surface inside the electrolytic cell 1 and fluorine gas generated in the anode 3 can be prevented. When hydrogen gas is generated on the bottom surface inside the electrolytic cell 1, the hydrogen gas is likely to approach the anode 3, and therefore there is a risk that the hydrogen gas causes a recombination reaction with the fluorine gas.

The type of the fluororesin or the ceramic is not particularly limited insofar as the fluororesin or the ceramic has corrosion resistance against an electrolytic solution. Examples of the fluororesin include, for example, polytetrafluoroethylene resin, tetrafluoroethylene-perfluoroalkyl vinyl ether copolymer resin, tetrafluoroethylene-hexafluoropropylene copolymer resin, tetrafluoroethylene-ethylene copolymer resin, polyvinylidene fluoride resin, polychlorotrifluoroethylene resin, and chlorotrifluoethylene-ethylene copolymer resin. As the ceramic, alumina is mentioned, for example.

(h-2) Diaphragm

It is preferable for the fluorine gas production device of this embodiment not to have a diaphragm (not illustrated) extending downward in the vertical direction from the partition wall 7. This diaphragm directly partitions the anode chamber 12 and the cathode chamber 14 of a portion (lower portion relative to the lower end of the partition wall 7) which is not directly partitioned by the partition wall 7 and is provided between the anode 3 and the cathode 5 to continuously extend downward in the vertical direction from the lower end of the partition wall 7.

When a diaphragm containing a metal mesh or the like is placed on the partition wall 7, there is a risk that double-polarization occurs in this portion, and then the metal of the diaphragm causes a dissolution reaction, so that the current efficiency decreases. Further, there is a risk that the metal of the diaphragm eluted into the electrolytic solution 10 is reduced by the cathode 5, so that sludge of metal fluoride is generated. Therefore, the sludge is required to be periodically removed, which makes it hard to perform a continuous electrolytic synthesis operation.

EXAMPLES

Hereinafter, the present invention is more specifically described by giving Examples and Comparative Examples.

Example 1

Fluorine gas was electrolytically synthesized using a fluorine gas production device having the same configuration as that of the fluorine gas production device illustrated in FIG. 1 and FIG. 2. In the electrolytic cell 1, both the lid 1*a* and the body 1*b* are formed of iron and have a rectangular parallelepiped shape with a length of 710 mm, a width of 240 mm, and a height of 590 mm. The electrolytic cell 1 contains the body 1*b* storing the electrolytic solution 10 and containing the bottom surface and the side surfaces and the lid 1*a* closing the upper opening of the body 1*b*, in which the body 1*b* and the lid 1*a* are insulated from each other (not illustrating an insulating member). Further, the bottom surface inside the body 1*b* of this electrolytic cell 1 is covered with the layered member 18 containing a 5 mm thick polytetrafluoroethylene sheet.

On the rear surface (equivalent to the ceiling surface inside the electrolytic cell 1) of the lid 1*a*, the partition wall 7 having a square cylindrical shape and formed of Monel (Trademark) is provided. The inside of the electrolytic cell 1 is partitioned by the partition wall 7 into the anode chamber 12 and the cathode chamber 14. The electrolytic cell 1 (lid 1*a*) includes the exhaust port 21 discharging fluorine gas generated in the anode 3 from the inside of the anode chamber 12 to the outside of the electrolytic cell 1 and includes the exhaust port 23 discharging hydrogen gas generated in the cathode 5 from the inside of the cathode chamber 14 to the outside of the electrolytic cell 1.

The anode 3 placed in the anode chamber 12 is a carbon electrode covered with conductive diamond and the shape thereof is a flat plate shape with a length of 450 mm, a width of 280 mm, and a thickness of 70 mm. Inside the electrolytic cell 1, two anodes 3 are placed. The anode 3 and the positive electrode of the direct-current power supply 20 placed outside the electrolytic cell 1 are connected to each other by the anode connection member 15. The anode connection member 15 is provided to penetrate the lid 1*a* of the electrolytic cell 1. The anode connection member 15 and the lid 1*a* of the electrolytic cell 1 are insulated from each other (not illustrating an insulating member).

The cathode 5 placed in the cathode chamber 14 is formed of Monel (Trademark) and the shape thereof is a flat plate shape with a length of 280 mm, a width of 670 mm, and a thickness of 2 mm.

To the cathode 5, the iron cooling pipe 16 is welded, so that the cathode 5 and the electrolytic solution 10 can be cooled. End portions of the cooling pipe 16 penetrate the side walls of the body 1*b* of the electrolytic cell 1 to project to the outside and are welded to the side walls of the body 1*b* of the electrolytic cell 1. The cooling pipe 16 is configured to allow the circulation of 120° C. steam or 60° C. warm water. In non-current application, the cooling pipe 16 is warmed by letting steam circulate in the cooling pipe 16, whereby the temperature of the electrolytic solution 10 can be maintained. In current application, the electrolysis temperature can be controlled by letting warm water circulate in the cooling pipe 16 while controlling the flow rate.

Further, the side walls of the body 1*b* of the electrolytic cell 1 and the negative electrode of the direct-current power supply 20 placed outside the electrolytic cell 1 are connected to each other. Therefore, a direct current is supplied from the direct-current power supply 20 to the cathode 5 via the side walls of the body 1*b* of the electrolytic cell 1 and the cooling pipe 16.

As the electrolytic solution 10, a mixed molten salt of potassium fluoride and hydrogen fluoride (with a molar ratio of potassium fluoride and hydrogen fluoride of Potassium fluoride:Hydrogen fluoride=1:2) was used. Then, the electrolytic solution 10 was charged into the electrolytic cell 1 such that the immersion length H of the partition wall 7 was 6.5 cm. The liquid level height of the electrolytic solution 10 is 44.0 cm, and therefore the immersion length H of the partition wall 7 is 14.8% of the liquid level height of the electrolytic solution 10.

Further, two liquid level sensors of a type of measuring the electrical resistance, i.e., upper A sensor and lower B sensor, were placed in the electrolytic cell 1. The A sensor stopping the supply of hydrogen fluoride was placed at a position where the A sensor operates at the immersion length H of 6.5 cm of the partition wall 7. The B sensor starting the supply of hydrogen fluoride was placed at a position where the B sensor operates at the immersion length H of 5.5 cm of the partition wall 7. The electrolytic solution level is 43.0 cm, and therefore the immersion length H of 5.5 cm of the partition wall 7 is 12.8% of the liquid level height of the electrolytic solution 10.

The anode 3 is partially exposed from the liquid level of the electrolytic solution 10. The cathode 5 is completely immersed in the electrolytic solution 10. The upper end of the cathode 5 is disposed at a lower position in the vertical direction relative to the lower end of the partition wall 7.

The shortest distance A between the anode 3 and the cathode 5 is 3.0 cm. The shortest distance B between the anode 3 and the partition wall 7 is 1.0 cm. The shortest distance C between the portion not facing the cathode 5 of the anode 3 and the side surfaces inside the body 1*b* of the electrolytic cell 1 is 6.5 cm and is 2.17 times the shortest distance A.

The liquid level area of the electrolytic solution 10 in the cathode chamber 14 measures 1084 $cm^2$.

A 940 A direct current was applied to the fluorine gas production device such that the apparent current density was 0.3 $A/cm^2$, and then electrolysis was performed while keeping the temperature of the electrolytic cell 1 at 90° C.

The electrolytic solution level was lowered in about 1.9 hours after the start of the current application to be positioned below the lower B sensor position. However, the electrolytic solution level was recovered to the upper A sensor position in about 4.4 hours by replenishing hydrogen fluoride with the supply amount of 1000 g/h. By repeating this behavior, the electrolysis for about 100 hours was continued.

As a result, fluorine gas and hydrogen gas were generated. The fluorine gas generation current efficiency was 99%. The hydrogen gas generation current efficiency was 99%.

The fluorine gas generation current efficiency is a rate of a value obtained by quantitatively measuring the fluorine gas actually generated in the anode 3 adsorbed into an aqueous potassium iodide solution to the fluorine gas generation amount calculated from the current application amount according to an electrolysis reaction formula. The hydrogen gas generation current efficiency is a rate of the hydrogen gas amount obtained by diluting gas generated in the cathode 5 by nitrogen gas whose flow rate is known, and then measuring the hydrogen gas concentration by gas chromatography to the hydrogen gas generation amount calculated from the current application amount according to an electrolysis reaction formula.

Example 2

Electrolysis was performed in the same manner as in Example 1, except that the material of the cathode 5 was changed to copper. As a result, the fluorine gas generation current efficiency was 99%. The hydrogen gas generation current efficiency was 99%.

Example 3

Electrolysis was performed in the same manner as in Example 1, except that a 2820 A direct current was applied such that the apparent current density was 0.9 A/cm$^2$ and the supply amount in replenishing hydrogen fluoride was set to 2500 g/h.

The electrolytic solution level was lowered in about 0.6 hour after the start of the current application to be positioned below the lower B sensor position. However, the electrolytic solution level was recovered to the upper A sensor position in about 3.3 hours by replenishing hydrogen fluoride with the above-described supply amount. By repeating this behavior, the electrolysis for about 100 hours was continued.

As a result, the fluorine gas generation current efficiency was 97%. The hydrogen gas generation current efficiency was 97%.

Example 4

Electrolysis was performed in the same manner as in Example 1, except that the material of the cathode 5 was changed to a punching plate formed of Monel (Trademark) with an opening ratio of 47%.

The electrolytic solution level was lowered in about 2.3 hours after the start of the current application to be positioned below the lower B sensor position. However, the electrolytic solution level was recovered to the upper A sensor position in about 3.0 hours by replenishing hydrogen fluoride with the supply amount of 1000 g/h. By repeating this behavior, the electrolysis for about 100 hours was continued.

As a result, the fluorine gas generation current efficiency was 81%. The hydrogen gas generation current efficiency was 81%.

Example 5

Electrolysis was performed in the same manner as in Example 1, except that a 4700 A direct current was applied such that the apparent current density was 1.5 A/cm$^2$ and the supply amount in replenishing hydrogen fluoride was set to 3000 g/h.

The electrolytic solution level was lowered in about 0.6 hour after the start of the current application to be positioned below the lower B sensor position. However, the electrolytic solution level was recovered to the upper A sensor position in about 1.8 hours by replenishing hydrogen fluoride with the above-described supply amount. By repeating this behavior, the electrolysis for about 100 hours was continued.

As a result, the fluorine gas generation current efficiency was 82%. The hydrogen gas generation current efficiency was 82%.

Example 6

Electrolysis was performed in the same manner as in Example 1, except that the A sensor stopping the supply of hydrogen fluoride was placed at a position where the A sensor operates at the immersion length H of 11.0 cm of the partition wall 7. The B sensor starting the supply of hydrogen fluoride was placed at a position where the B sensor operates at the immersion length H of 6.5 cm of the partition wall 7. Since the electrolytic solution level is 48.5 cm, the immersion length H of 11.0 cm of the partition wall 7 is 22.7% of the liquid level height of the electrolytic solution. Since the electrolytic solution level is 44.0 cm, the immersion length H of 6.5 cm of the partition wall 7 is 14.8% of the liquid level height of the electrolytic solution.

The electrolytic solution level was lowered in about 1.9 hours after the start of the current application to be positioned below the lower B sensor position. However, the electrolytic solution level was recovered to the upper A sensor position in about 4.4 hours by replenishing hydrogen fluoride with the supply amount of 1000 g/h. By repeating this behavior, the electrolysis for about 100 hours was continued.

As a result, the fluorine gas generation current efficiency was 99%. The hydrogen gas generation current efficiency was 99%.

Comparative Example 1

Electrolysis was performed in the same manner as in Example 1, except that the vertical dimension of the cathode 5 was increased by 70 mm from 280 mm to be set to 350 mm, such that the upper end of the cathode 5 is exposed from the liquid level of the electrolytic solution 10.

The electrolytic solution level was lowered in about 2.9 hours after the start of the current application to be positioned below the lower B sensor position. However, the electrolytic solution level was recovered to the upper A sensor position in about 2.4 hours by replenishing hydrogen fluoride with the supply amount of 1000 g/h. By repeating this behavior, the electrolysis for about 100 hours was continued.

As a result, a bursting sound due to a reaction between the fluorine gas and the hydrogen gas in a gas phase part was occasionally generated during the electrolysis. The fluorine gas generation current efficiency was 65%. The hydrogen gas generation current efficiency was 65%.

Comparative Example 2

Electrolysis was performed in the same manner as in Example 1, except that the A sensor stopping the supply of hydrogen fluoride was placed at a position where the A sensor operates at the immersion length H of 2.5 cm of the partition wall 7. The B sensor starting the supply of hydrogen fluoride was placed at a position where the B sensor operates at the immersion length H of 1.5 cm of the partition wall 7. Since the electrolytic solution level is 40.0 cm, the immersion length H of 2.5 cm of the partition wall 7 is 6.25% of the liquid level height of the electrolytic solution. Since the electrolytic solution level is 39.0 cm, the immersion length H of 1.5 cm of the partition wall 7 is 3.8% of the liquid level height of the electrolytic solution.

The electrolytic solution level was lowered in about 2.6 hours after the start of the current application to be positioned below the lower B sensor position. However, the electrolytic solution level was recovered to the upper A sensor position in about 2.7 hours by replenishing hydrogen fluoride with the supply amount of 1000 g/h. By repeating this behavior, the electrolysis for about 100 hours was continued.

As a result, a bursting sound due to a reaction between the fluorine gas and the hydrogen gas in a gas phase part was occasionally generated during the electrolysis. The fluorine gas generation current efficiency was 73%. The hydrogen gas generation current efficiency was 73%.

REFERENCE SIGNS LIST

1 electrolytic cell
3 anode
5 cathode
7 partition wall
10 electrolytic solution
12 anode chamber
14 cathode chamber
15 anode connection member
16 cooling pipe (cathode connection member)
18 layered member
20 direct-current power supply
21 exhaust port (for anode gas)
23 exhaust port (for cathode gas)

The invention claimed is:

1. A fluorine gas production device electrolyzing an electrolytic solution containing hydrogen fluoride to electrolytically synthesize fluorine gas comprising:

an electrolytic cell configured to store the electrolytic solution;

a cylindrical partition wall configured to extend downward in a vertical direction from a ceiling surface inside the electrolytic cell to partition an inside of the electrolytic cell into an anode chamber and a cathode chamber;

an anode configured to be disposed in the anode chamber;

a cathode configured to be disposed facing the anode; and a cathode connection member configured to supply power to the cathode, wherein a lower end of the partition wall is immersed in the electrolytic solution, a length in the vertical direction of a portion immersed in the electrolytic solution of the partition wall is 10% or more and 30% or less of a distance from a bottom surface inside the electrolytic cell to a liquid level of the electrolytic solution, the cathode is completely immersed in the electrolytic solution, an upper end of the cathode is arranged at a same position in the vertical direction as a position of the lower end of the partition wall or at a lower position in the vertical direction relative to the lower end of the partition wall, the anode is placed to be partially exposed from the liquid level of the electrolytic solution, the cathode connection member has one end physically connected to a bottom wall or a portion at a lower position in the vertical direction relative to the lower end of the partition wall of a side wall of the electrolytic cell and another end connected to the cathode, the cathode connection member is a pipe used for cooling, a portion of the cathode facing the anode is constituted by a flat plate or a flat plate including a through-hole with an opening ratio of 20% or less, and the liquid level of the electrolytic solution is maintained by replenishing hydrogen fluoride.

2. The fluorine gas production device according to claim 1 further comprising:

an anode connection member configured to supply power to the anode, wherein the anode connection member has one end connected to a positive electrode of a direct-current power supply and another end penetrating a wall body of the electrolytic cell to be connected to the anode, the anode connection member and the electrolytic cell are insulated from each other, and the electrolytic cell and a negative electrode of the direct-current power supply are connected to each other.

3. The fluorine gas production device according to claim 1, wherein the cathode connection member is a metal pipe allowing circulation of a fluid.

4. The fluorine gas production device according to claim 1, wherein the anode and the cathode have a flat plate shape, a plate surface of the anode, a plate surface of the cathode, a wall of the partition wall facing the plate surface of the anode, and a side surface inside the electrolytic cell facing the plate surface of the anode are provided to be parallel in the vertical direction, a shortest distance A between the anode and the cathode is 2.0 cm or more and 5.0 cm or less, a shortest distance B between the anode and the partition wall is 0.5 cm or more and 2.5 cm or less and is smaller than the shortest distance A, and a shortest distance C between a portion not facing the cathode of the anode and the side surface inside the electrolytic cell is 1.5 times or more and 3 times or less the shortest distance A.

5. The fluorine gas production device according to claim 1, wherein the bottom surface inside the electrolytic cell is covered with an electrically insulating layered member formed of fluororesin or ceramic.

6. The fluorine gas production device according to claim 1, wherein the portion of the cathode facing the anode is formed of at least one type of material selected from Monel (Trademark), nickel, and copper.

7. The fluorine gas production device according to claim 1 not comprising:

a diaphragm configured to extend downward in the vertical direction from the partition wall to partition the inside of the electrolytic cell into the anode chamber and the cathode chamber.

8. The fluorine gas production device according to claim 2, wherein the anode and the cathode have a flat plate shape, a plate surface of the anode, a plate surface of the cathode, a wall of the partition wall facing the plate surface of the anode, and a side surface inside the electrolytic cell facing the plate surface of the anode are provided to be parallel in the vertical direction, a shortest distance A between the anode and the cathode is 2.0 cm or more and 5.0 cm or less, a shortest distance B between the anode and the partition wall is 0.5 cm or more and 2.5 cm or less and is smaller than the shortest distance A, and a shortest distance C between a portion not facing the cathode of the anode and the side surface inside the electrolytic cell is 1.5 times or more and 3 times or less the shortest distance A.

9. The fluorine gas production device according to claim 3, wherein the anode and the cathode have a flat plate shape, a plate surface of the anode, a plate surface of the cathode, a wall of the partition wall facing the plate surface of the anode, and a side surface inside the electrolytic cell facing the plate surface of the anode are provided to be parallel in the vertical direction, a shortest distance A between the anode and the cathode is 2.0 cm or more and 5.0 cm or less, a shortest distance B between the anode and the partition wall is 0.5 cm or more and 2.5 cm or less and is smaller than the shortest distance A, and a shortest distance C between a portion not facing the cathode of the anode and the side surface inside the electrolytic cell is 1.5 times or more and 3 times or less the shortest distance A.

10. The fluorine gas production device according to claim 2, wherein the bottom surface inside the electrolytic cell is covered with an electrically insulating layered member formed of fluororesin or ceramic.

11. The fluorine gas production device according to claim 3, wherein the bottom surface inside the electrolytic cell is covered with an electrically insulating layered member formed of fluororesin or ceramic.

12. The fluorine gas production device according to claim 4, wherein the bottom surface inside the electrolytic cell is covered with an electrically insulating layered member formed of fluororesin or ceramic.

13. The fluorine gas production device according to claim 2, wherein a portion facing the anode of the cathode is formed of at least one type of material selected from Monel (Trademark), nickel, and copper.

14. The fluorine gas production device according to claim 3, wherein a portion facing the anode of the cathode is formed of at least one type of material selected from Monel (Trademark), nickel, and copper.

15. The fluorine gas production device according to claim 4, wherein a portion facing the anode of the cathode is formed of at least one type of material selected from Monel (Trademark), nickel, and copper.

16. The fluorine gas production device according to claim 5, wherein a portion facing the anode of the cathode is formed of at least one type of material selected from Monel (Trademark), nickel, and copper.

* * * * *